United States Patent [19]

Romine

[11] Patent Number: 4,931,162

[45] Date of Patent: Jun. 5, 1990

[54] PROCESS FOR PRODUCING CLEAN DISTILLATE PITCH AND/OR MESOPHASE PITCH FOR USE IN THE PRODUCTION OF CARBON FILTERS

[75] Inventor: Hugh E. Romine, Ponca City, Okla.

[73] Assignee: Conoco Inc., Ponca City, Okla.

[21] Appl. No.: 106,465

[22] Filed: Oct. 9, 1987

[51] Int. Cl.[5] ..... C10C 1/00; C10C 3/00

[52] U.S. Cl. ..... 208/41; 208/22; 208/34; 208/40; 423/447.4; 423/448

[58] Field of Search ..... 208/41, 39, 22, 40; 423/447.4, 448

[56] References Cited

U.S. PATENT DOCUMENTS

| | | | |
|---|---|---|---|
| 4,271,006 | 6/1981 | Dickakian | 208/41 |
| 4,303,631 | 12/1981 | Lewis et al. | 208/44 |
| 4,317,809 | 3/1982 | Lewis et al. | 208/44 |
| 4,363,715 | 12/1982 | Dickakian | 208/44 |
| 4,427,530 | 1/1984 | Dickakian | 208/44 |
| 4,487,685 | 12/1984 | Watanabe | 208/44 |
| 4,488,957 | 12/1984 | Noguchi | 208/44 |
| 4,551,225 | 11/1985 | Dickakian | 208/44 |
| 4,608,150 | 8/1986 | Itoi et al. | 208/41 |

OTHER PUBLICATIONS

The Condensed Chemical Dictionary, 10th Ed., Gessner, G., Hawley, Van Nostrand, Reinhold, W., 1981, p. 1007.

*Primary Examiner*—Helane Myers

[57] ABSTRACT

A clean pitch suitable for the manufacture of carbon artifacts is obtained by distilling from an aromatic feedstock a distillate material free from mesophase forming resins. The distillate is heated to obtain a heat soaked distillate free from mesophase but containing mesophase forming resins. The heat soaked distillate is further heated with inert gas sparging to convert it to mesophase pitch suitable for manufacturing carbon fibers. The heat soaked distillate also finds use as a binder or impregnation pitch.

6 Claims, No Drawings

PROCESS FOR PRODUCING CLEAN DISTILLATE PITCH AND/OR MESOPHASE PITCH FOR USE IN THE PRODUCTION OF CARBON FILTERS

BACKGROUND AND SUMMARY OF INVENTION

It is well known that carbon fibers having excellent properties suitable for commercial use can be produced from mesophase pitch. Mesophase pitch derived carbon fibers are lightweight, strong, stiff, electrically conductive, and both chemically and thermally inert. The mesophase derived carbon fibers perform well as reinforcements in composites and have found use in aerospace applications and quality sporting equipment.

Carbon fibers have been made commercially from three types of precursor materials, rayon, polyacrylonitrile, and pitch. The use of pitch as a precursor material is attractive economically.

Low cost carbon fibers produced from isotropic pitch exhibit little molecular orientation and relatively poor mechanical properties. In contrast carbon fibers produced from mesophase pitch exhibit high preferred molecular orientation and relatively excellent mechanical properties.

As used herein the term "pitch" generally refers to a carbonaceous residue consisting of a complex mixture of primarily aromatic organic compounds which are solid at room temperature and exhibit a relatively broad melting or softening temperature range. When cooled from the melt the pitch is solidified without crystallization.

The term "mesophase" is to be understood as used in the prior art and is synonymous with liquid crystal, that is a state of matter which is intermediate between crystalline solid and an isotropic liquid. Ordinarily material in the mesophase state exhibits both anisotropic and liquid properties.

As used herein the term "mesophase pitch" is a pitch containing more than about 40 percent by weight mesophase and is capable of forming a continuous anisotropic phase when dispersed by agitation in accordance with the prior art.

A number of methods for preparing mesophase pitch have been disclosed in the prior art. Generally they involve (a) isolation of an aromatic resin containing material, and (b) heat soaking in combination with gas sparging or solvent fluxing to produce a mesophase pitch.

Ashland A240 pitch, a commercial petroleum pitch, is commonly used as a mesophase pitch precursor. It has a high resin content and produces mesophase pitch yields as high as 50 percent. Ashland A240 pitch contains a moderate amount of solids (typically 150 ppm ash) which diminishes the value of the carbon fibers it produces.

There are a wide variety of feedstocks which can be used for the preparation of petroleum mesophase pitch. Petroleum decant oils and petroleum thermal tars are suitable feeds but they generally produce low mesophase pitch yields (approximately 10 percent). Also pitches from these feeds usually contain large amounts of undesirable solids.

Coal tar pitches are usually very high in carbonaceous solids which must be removed before they are acceptable mesophase pitch precursors.

Aromatic distillates have been thermally treated to make resin containing pitches. Short, hot, high pressure thermal treating makes suitable material not unlike petroleum decant oil or thermal tar. Carbonaceous material usually contaminates the products when conditions are severe enough to make more than a low yield of resin material.

All of the above feed materials contain either solids such as ash, or catalyst fines, or a carbonaceous material such as coke, all of which have adverse effects on the properties of carbonaceous products produced from these feeds. This limits their usefulness as impregnation or binder pitches and adversely affects the properties of carbon fibers made from mesophase pitch prepared from these materials.

According to the present invention, a mesophase pitch substantially free from carbonaceous insolubles and from ash and ash catalyst fines and other solids is obtained by distilling an aromatic containing feedstock to obtain a distillate which is free from mesophase and mesophase forming resins. The distillate is heat soaked without gas sparging at elevated temperatures for a sufficient period of time to obtain a heat soaked distillate which is free from mesophase but contains at least 5 percent mesophase forming resins. The heat soaked distillate is further heated at elevated temperatures with inert gas sparging to convert it to mesophase pitch suitable for the manufacture of carbon fibers. Alternatively the heat soaked distillate may be used as a binder or impregnation pitch.

PRIOR ART

U.S. Pat. No. 4,303,631 to Lewis et al discloses a process for converting various feed materials into a mesophase containing pitch by a first heat treatment without sparging to obtain a pitch having a mesophase content from about 20 to 50 percent. This pitch is subjected to a second heat treatment with sparging with an inert gas until a mesophase pitch having a mesophase content of at least 70 percent by weight as obtained. The pitch is then further processed to make carbon fibers.

U.S. Pat. No. 4,363,715 to Dickakian discloses a process for preparing a pitch suitable for the manufacture of carbon fibers by obtaining a distillate from cat cracker bottoms, heat soaking the distillate at elevated temperatures to provide a pitch and vacuum stripping the heat soaked distillate to remove material boiling below about 400° C. The pitch thus obtained can be further processed to obtain carbon fibers.

DETAILED DESCRIPTION OF THE INVENTION

The distillates employed in carrying out the invention may be obtained from any of the aromatic feedstocks previously mentioned, including high boiling petroleum gas oils and petroleum resids. They can be obtained by subjecting such feedstocks to conventional vacuum distillation or by wiped film evaporation or by gas stripping. Hydrotreating of the distillate or the feedstock from which the distillate is obtained is sometimes preferred.

Distillates boiling above 500° F. or even above 750° F. are preferred. The end point of the distillates will be established by the heaviest material which can be distilled from the feedstock. Usually the end point will be a maximum of about 970° F. For example, when using a decant oil as the source, a distillate can be obtained which has a boiling range from about 780° to about 970°

F. In one aspect of the invention the distillate heat soak is carried out at atmospheric pressure so it is desirable that the initial boiling point of the distillate be greater than the temperatures employed in the heating steps.

Heat soaking of the distillate is usually carried out at a temperature in the range of about 660° to about 860° F. for about 2 to about 240 hours. Lower soak temperatures require longer soak times. The preferred soaking conditions are from about 6 to about 96 hours at a temperature range of about 700° to about 800° F. Soaking is preferably carried out at atmospheric pressure but higher pressures may be required to prevent boiling of lighter ends in the distillate. The heat soaking is effected in an inert gas atmosphere preferably with agitation of the distillate. However, no gas sparging is employed in the heat soaking operation.

The heat soaked distillate contains at least about 5 percent mesophase forming resins and preferably at least about 15 percent. The amount of mesophase obtained by subsequently sparging the heat soaked distillate is directly related to the amount of mesophase forming resins in such distillate. The amount of mesophase forming resins in the distillate can be estimated by measuring the Conradson carbon content of the distillate. In addition, the Richfield pentane insolubles are also a useful estimate of the resin content of the distillate. While resins are essential in the heat soaked distillate, carbonaceous insolubles are undesirable. High contents of selected solvent insolubles are indicative of the presence of carbonaceous insoluble materials. The quinoline insolubles of the heat soaked distillate should be less than 5.0 percent and preferably the THF insolubles are less than 20.0 percent.

As previously pointed out, solids impurities in the mesophase pitch have an adverse effect on the properties of carbon fibers made from such pitch. By utilizing the distillate materials employed in carrying out the invention, heat soaking conditions can be employed which do not generate large amounts of insoluble materials. Also since the disclosed distillates are used the resulting pitch material is free from the ash and catalyst fines normally present in other petroleum feedstocks.

Conversion of the heat soaked distillate to mesophase pitch is effected by subjecting the distillate to elevated temperatures usually at atmospheric pressure with agitation and with inert gas sparging. The operating conditions employed, which are well known in the art, include temperatures in the range of about 650° to about 925° F. and preferably from about 700° to about 800° F. The heating step is carried out over a time period of about 2 to about 60 hours depending on the temperature employed. A variety of inert gases may be used as a sparging material including nitrogen, argon, carbon dioxide, helium, methane, carbon monoxide, and steam. Sparging is carried out at a gas rate of at least 1.0 standard cubic feet per hour per pound of heat soaked distillate and preferably from about 1.5 to about 10 standard cubic feet per hour per pound.

The mesophase pitch obtained in the processes is extremely clean and free from ash catalyst particles and carbonaceous solids. As such it constitutes a very high quality precursor material for the production of carbon fiber.

In addition to its use in the preparation of mesophase pitch the cleanliness of heat soaked distillate provides a material which is valuable as a binder or impregnation pitch. In such use the distillate penetrates or impregnates better than ordinary pitches and binds better since it contains little or no solids.

The following examples illustrate the results obtained in carrying out the invention.

EXAMPLE 1

A highly aromatic petroleum decant oil was vacuum distilled to yield 43.3% of a 780°–970° F. distillate cut. This aromatic distillate was analyzed to contain 0.1% Richfield pentane insolubles and no toluene insolubles. The distillate was heat soaked 48 hours at 700° F. and at atmospheric pressure. The heat soaked distillate obtained in 89.5% yield contained 25.9% Richfield pentane insolubles, 21.1% Conradson carbon residuals, 0.9% toluene insolubles and no THF insolubles. The heat soaked distillate was converted to mesophase pitch by further heat soaking 32 hours at 725° F. while sparging with nitrogen at a rate of 4 SCF/hr-lb. The mesophase pitch yield was 18.8% (16.8% on original distillate). The mesophase pitch was analyzed to be 100% mesophase melting at 308° C. It was melt spun into carbon fibers which were oxidatively stabilized and carbonized to 1950° C. The resulting fibers showed a tensile strength of 510 KPSI and a tensile modulus of 61 MPSI.

The same petroleum decant oil was topped to isolate a 900° F.+ aromatic pitch residue. This material was heat soaked 32 hours at 725° F. while nitrogen sparging at a rate of 4 SCF/hr-lb of pitch. The heat soaked pitch obtained in 24% yield was analyzed by optical microscopy to be 99% anisotropic material melting at 305° C. This material was spun into carbon fibers which were oxidatively stabilized and carbonized to 1950° C. The resulting fibers showed a tensile strength of 135 KPSI and a tensile modulus of 42 MPSI.

EXAMPLE 2

A highly aromatic thermal petroleum residue was vacuum distilled to yield 36.2% of a 780°–970° F. distillate. This aromatic distillate was analyzed to contain 0.1% Richfield pentane insolubles and no toluene insolubles. The distillate was heat soaked 48 hours at 700° F. and at atmospheric pressure. Heat soaked distillate was recovered in 82.7% yield. This product was analyzed to have 18.0% Richfield pentane insolubles, 17.3% Conradson carbon residuals and no toluene or tetrahydrofuran (THF) insolubles. The heat soaked distillate was converted to mesophase pitch by further heat soaking 32 hours at 725° F. while sparging with a 4 SCF/hr-lb of nitrogen. The mesophase pitch yield was 17.1% (14.1% on original distillate). The mesophase pitch was analyzed to be 100% mesophase melting at 324° C. It was melt spun into carbon fibers which were oxidatively stabilized and then carbonized to 1950° C. The resulting fibers showed a tensile strength of 413 KPSI and a tensile modulus of 55 MPSI.

The same thermal petroleum residue was vacuum topped to isolate a 900° F.+ aromatic pitch. This pitch was heat soaked for 32 hours at 725° F. while nitrogen sparging at a rate of 4 SCF/hr-lb. The heat soaked pitch obtained in 31% yield was analyzed by optical microscopy to be 100% anisotropic material melting at 318° C. This material was melt spun into carbon fibers which were oxidatively stabilized and carbonized to 1950° C. The resulting fibers showed a tensile strength of 290 KPSI and a tensile modulus of 50 MPSI.

Examples 1 and 2 illustrate the improvement in tensile strength and tensile modulus in carbon fibers obtained from distillates free from mesophase pitch which have been obtained by practicing the process of the invention.

EXAMPLE 3

Feeds for Example 3 were also a decant oil and a thermal tar. The test procedure is outlined for each feed in Charts 1 and 2. The feeds were topped in two ways. The first topping was to 900° F. to produce a 900° F.+ residue for conversion to sparge mesophase. Each feed was also topped to 780° F. and 952° F. (or 970° F.) to isolate a 780 to 952 (970) middle distillate cut. This middle distillate was used as feed for the 700° F. resin forming heat soaks. The residues from these heat soaks were then used as feeds for mesophase forming sparge heat soaks. Direct sparge mesophase production from non-heat-soaked distillate was also attempted. The heat soak conditions, yields and pitch analyses are all shown in Charts 1 and 2.

CHART 1

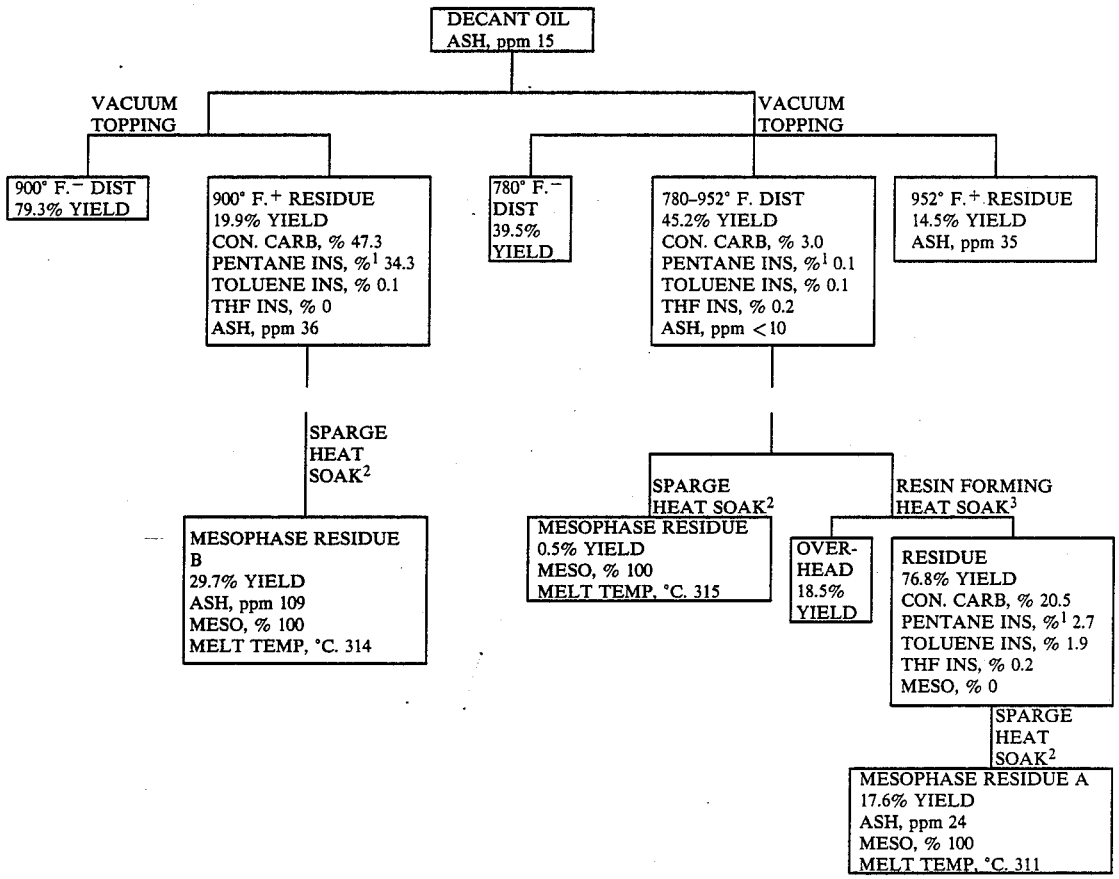

[1]RICHFIELD METHOD
[2]SPARGE CONDITIONS: 725° F., 32 hours, 4 SCF $N_2$/hr lb of Feed
[3]RESIN FORMING CONDITIONS: 700° F., 51.5 hours

CHART 2

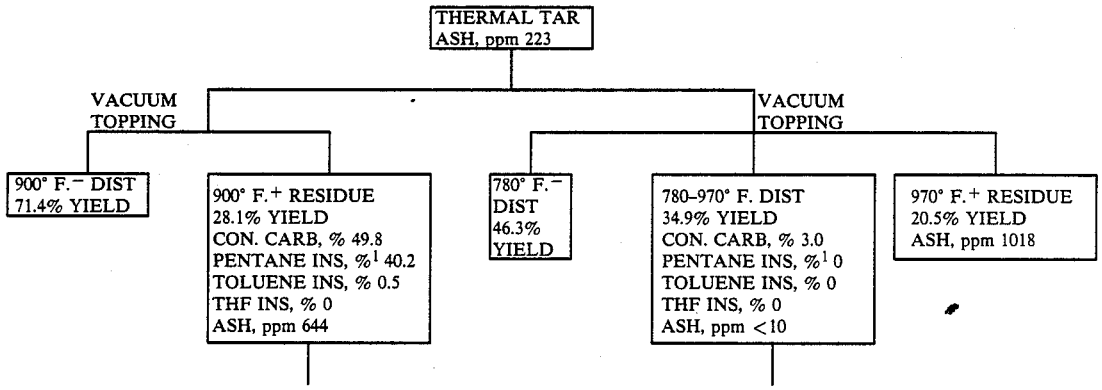

-continued
CHART 2

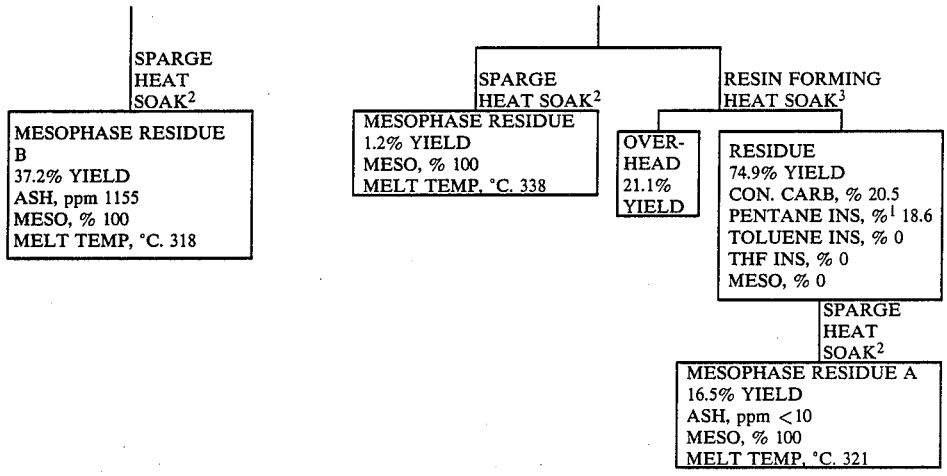

[1]RICHFIELD METHOD
[2]SPARGE CONDITIONS: 725° F., 32 hours, 4 SCF $N_2$/hr lb of Feed
[3]RESIN FORMING CONDITIONS: 700° F., 48 hours Ash analysis on the distillates and residues in the above Example shows that contaminants are concentrated in the residues. This effect can be seen both in the low ash decant oil and the thermal tar. Ash in the distillates is below detection limits of 10 ppm. The low ash content of distillates is retained during the resin forming and sparge heat soaks. Consequently mesophase prepared from heat soaked distillate residue is much lower in ash than mesophase prepared from conventional residues.

The resin forming heat soak produces significant amounts of mesophase formers in the distillate. When the distillate is sparged directly only around a 1% yield of mesophase is produced. The resin forming reaction yields about 75% residue which yields nearly 17% mesophase from each distillate. Thus the heat soaked distillate clearly contains more than 5 percent mesophase forming resins.

EXAMPLE 4

Carbon fibers were prepared from the sparge mesophases in Example 3 to demonstrate the advantages of clean mesophase. The fibers were made by melt spinning the pitch, followed by oxidative stabilizing and carbonizing to 1800° C. Fiber properties are shown in Table 1.

TABLE 1

| | | 1" Filament Properties | | |
|---|---|---|---|---|
| Pitch Type | Mesophase Residue | Tensile Strength, KPSI | Elongation, % | Modulus, MPSI |
| Decant Oil | | | | |
| Distillate | A | 334 | 0.54 | 48 |
| Residue | B | 205 | 0.46 | 37 |
| Thermal Tar | | | | |
| Distillate | A | 328 | 0.71 | 35 |
| Residue | B | 252 | 0.67 | 31 |

The fiber properties in Table 1 show higher tensile strength and higher elongation for the distillate-feed fibers. Tensile modulus or stiffness is also higher for the fibers from distillate. Since all the fibers were carbonized under the same conditions, this indicates greater graphitizability in distillate-feed mesophase.

I claim:

1. A process for preparing a mesophase pitch suitable for the production of high quality carbon fibers which comprises distilling from an aromatics-containing feedstock an aromatic distillate free from mesophase and mesophase-forming resins and having an initial boiling point at atmospheric pressure of above 750° F., heat soaking said distillate without gas sparging at atmospheric pressure and temperatures of from about 660° F. to about 860° F. for a time of from about 2 to about 240 hours to obtain a heat soaked distillate free from mesophase but containing at least 5 percent mesophase-forming resins and having a tetrahydrofuran insolubles content less than 20 percent, then subjecting the heat soaked distillate to further heating at a temperature of from about 700° F. to about 800° F. for a time of about 6 to about 46 hours and atmospheric pressure with inert gas sparging to convert said resins to mesophase pitch.

2. The process of claim 1 in which the aromatic distillate has a boiling range of from about 780° F. to about 970° F.

3. The process of claim 1 in which the mesophase pitch is melt spun into carbon fibers.

4. A process for preparing a mesophase pitch suitable for the production of high quality carbon fibers which comprises distilling from an aromatics-containing feedstock an aromatic distillate free from mesophase and mesophase-forming resins and having an initial boiling point at atmospheric pressure above 750°, but ranging from about 780° F. to about 970° F., heat soaking said distillate with agitation but without gas sparging at atmospheric pressure and temperatures from about 660° F. to about 860° F. for a time of from about 2 to about 240 hours to obtain a heat soaked distillate free from mesophase but having Conradson carbon content of at least 15 percent and having a tetrahydrofuran insolubles content less than 20 percent and subjecting the heat soaked distillate to further heating at temperatures of from about 700° F. to about 800° F. for from about 6 to about 96 hours and atmospheric pressure with agitation and inert gas sparging to convert mesophase-forming resins to mesophase pitch.

5. The process of claim 4 in which the aromatics-containing feedstock is a decant oil.

6. A process which comprises distilling from an aromatics-containing feedstock, an aromatic distillate having a boiling point at atmospheric pressure from about 780° F. to about 970° F. free from mesophase and mesophase-forming resins and heat soaking said distillate without gas sparging at temperatures from about 660° F. to about 860° F. for from about 2 to about 240 hours to obtain a heat soaked distillate free from mesophase, but containing at least 5 percent mesophase-forming resins.

* * * * *